United States Patent [19]

Röck et al.

[11] Patent Number: 4,750,238

[45] Date of Patent: Jun. 14, 1988

[54] HINGE

[75] Inventors: Erich Röck, Höchst; Klaus Brüstle; Helmut Rupprechter, both of Lauterach, all of Austria

[73] Assignee: Julius Blum Gesellschaft m.b.H., Höchst, Austria

[21] Appl. No.: 937,620

[22] Filed: Dec. 1, 1986

[30] Foreign Application Priority Data

Dec. 10, 1985 [AT] Austria ..... 3570/85

[51] Int. Cl.[4] ..... E05D 7/06; E05D 11/00

[52] U.S. Cl. ..... 16/241; 16/250; 16/270; 16/272; 16/324; 16/347; 16/349; 403/330

[58] Field of Search ..... 16/DIG. 43, 241, 250, 16/254, 270, 272, 319, 321, 324, 347, 349; 29/11; 403/330

[56] References Cited

U.S. PATENT DOCUMENTS 4,359,802 11/1982 Röck ..... 16/DIG. 43
4,430,771 2/1984 Salice ..... 16/258
4,654,932 4/1987 Röck et al. ..... 16/DIG. 43

FOREIGN PATENT DOCUMENTS 2806958 8/1978 Fed. Rep. of Germany .... 16/DIG. 43
3446544 6/1986 Fed. Rep. of Germany ..... 16/250
3500423 7/1986 Fed. Rep. of Germany ..... 16/250

*Primary Examiner*—Nicholas P. Godici
*Assistant Examiner*—Samuel M. Heinrich
*Attorney, Agent, or Firm*—Wenderoth, Lind & Ponack

[57] ABSTRACT

A hinge has a hinge arm which is snappable onto a mounting plate by means of an intermediate member. The front of the intermediate member is engageable into the mounting plate and the rear of the intermediate member is provided with a pivot lever having a hook member by means of which the pivot lever locks the intermediate member to the mounting plate. A cover member is mounted on the hinge arm and at its rear end has a shoulder which embraces the end of the hinge arm and extends between the hinge arm and the pivot lever, so that the pivot member cannot be released from the mounting plate unintentionally.

5 Claims, 2 Drawing Sheets

HINGE

FIELD AND BACKGROUND OF THE INVENTION

The invention relates to a hinge comprising adjusting devices, in which a hinge arm is fastenable to a mounting plate by means of at least one intermediate member and is linked to a second hinge part, for example a hinge casing, by means of hinge links or the like, the hinge arm having holes through which adjusting and fastening screws extend, and the intermediate member being engageable and lockable with the mounting plate by means of a pivot lever pivotally mounted on the intermediate member and having a hook member which engages with a projection of the mounting plate.

In conventional hinges the hinge arm is fastened to the mounting plate by means of a clamping screw, such clamping screw generally projecting through an elongated hole to allow an adjustment of the hinge arm in the direction of the depth of the piece of furniture.

Lately snap-in connections for fastening the hinge arm to the mounting plate have become known. DE-A-30 26 796 and DE-A-30 39 328, for example, describe hinges comprising a hinge arm and a fastening plate in which the two parts to be locked snap together by inserting the hinge arm into a guide of the fastening plate and displacing the same in a longitudinal direction. A similar way of locking a hinge arm to a mounting plate is shown in DE-A-24 60 127. DE-A-32 41 284 shows a hinge in which the hinge arm is insertable into lateral guides of a mounting plate and clampable to the mounting plate by means of an eccentric.

The above-described means for locking the hinge arm to the mounting plate have the advantage that, when the piece of furniture is being assembled, the hinge arm can be quickly fastened to the mounting plate and, furthermore, that no tool is necessary for such mounting operation. This advantage is not unimportant because the door must be held when the hinge arm is being engaged. When, for example, the door is held with one hand and the hinge arm is to be mounted with the other hand, a second person, who fastens the clamping screw with a screw driver, is often needed, if the hinge arm is held by means of a clamping screw.

It is a disadvantage of hinges in which the hinge arm or the intermediate member is insertable into the mounting plate from the front that tilting frequently occurs. This is particularly the case with doors having many hinges. AT-PS 360 856 describes a hinge whose intermediate member is engageable at one end in the mounting plate and which has a pivot lever at the other end by means of which it is lockable to the mounting plate.

SUMMARY OF THE INVENTION

It is the object of the invention to improve a hinge of the above mentioned type, whereby it is possible to prevent the hinge arm and the intermediate member from unintentionally disengaging from the mounting plate.

According to the invention this is achieved in that a cover member is mounted on the hinge arm and that the rear of such cover member is provided with a shoulder which embraces the end of the hinge arm and extends between the hinge arm and the pivot lever.

By means of the cover member designed according to the invention locking of the pivot lever is effective only if the hinge arm has been correctly adjusted and fixed.

It is advantageously provided that the shoulder of the cover member extends between the hinge arm and a handle of the pivot lever.

It is further advantageously provided that two shoulders of the cover member rest snugly on respective lateral flanges of the hinge arm which has a U-shaped profile, the two shoulders being connected by means of a flange.

BRIEF DESCRIPTION OF DRAWINGS

An embodiment of the invention will now be described in more detail with reference to the accompanying drawings, wherein.

Figure 1:
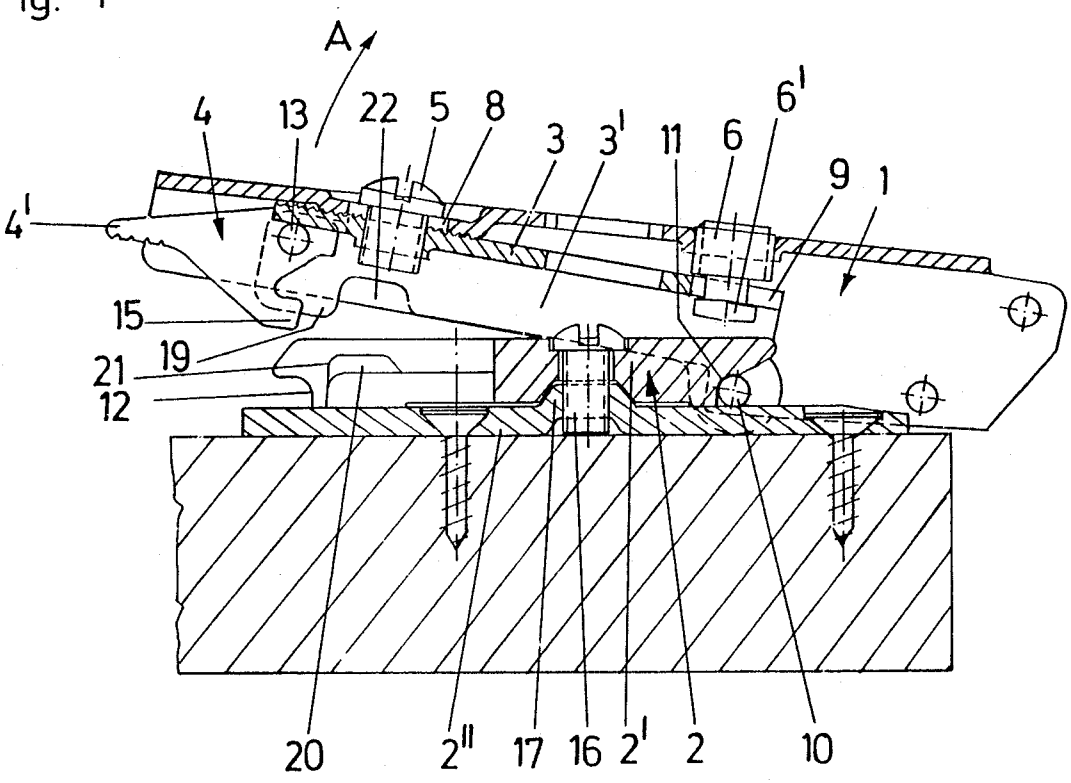
FIG. 1 is a longitudinal sectional view of a hinge arm and a mounting plate in a position when the hinge arm is being engaged.

In the drawings those hinge parts which are not directly related to the present invention, such as the hinge casing and the hinge links, are not shown. They are made according to the state of the art.

DESCRIPTION OF THE PREFERRED EMBODIMENT

As can be seen from the drawings, the essential parts of the hinge according to the invention are a hinge arm 1, a mounting plate 2 and an intermediate member 3 with a pivot lever 4.

The hinge arm 1 is fastened to the intermediate member 3 by means of a joint adjustment screw 6 which is mounted in a female thread in the hinge arm 1 and by means of a clamping screw 5 which also serves for depth adjustment. The clamping screw 5 projects through a slot 8 in the hinge arm 1, and the joint adjustment screw 6 has a head 6' held in a slot 9 in the intermediate member 3. By releasing the clamping screw 5, the hinge arm 1 can be displaced over the length of the slot 8 and hence in the direction of the depth of the piece of furniture. The adjustment in the direction of the door joint is effected in a conventional manner by turning the joint adjustment screw 6.

The mounting plate 2 as well as the intermediate member 3 have U-shaped profiles.

At the front the intermediate member 3 is provided with a pin 10 which serves as a holding projection of the intermediate member 3. The mounting plate 2 has a notch 11 at its front in which the pin 10 is engageable to be held at the mounting plate 2.

At its rear end the mounting plate 2 is also provided with a notch 12.

The pivot lever 4 is mounted at the rear end of the hinge arm 1 by means of a bolt 13. A hook member 15 is formed on the pivot lever 4.

The pivot lever 4 is acted upon by a spring 7 which abuts with one end on the hinge arm 1. In the illustrated embodiment the spring 7 is a leg spring which is arranged in a recess 18 of the pivot lever 4.

Figures 2, 3:
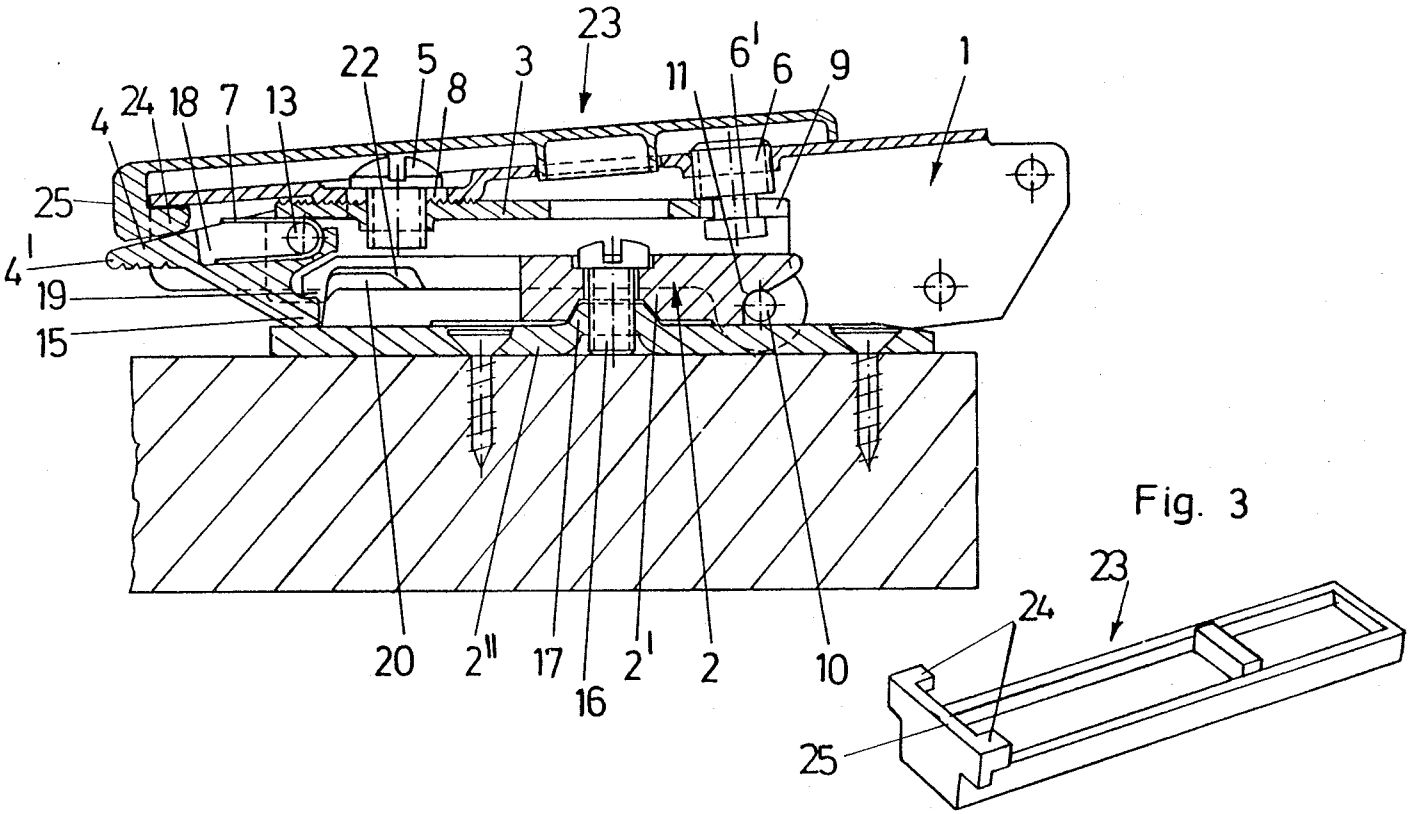
FIG. 2 is a longitudinal sectional view of the hinge arm and the mounting plate, the hinge arm being in a mounted position.
FIG. 3 is a diagrammatic view of a cover member according to the invention viewed from below.

When the hinge arm 1 and the intermediate member 3 are pressed from the position shown in FIG. 1 into the position shown in FIG. 2, the hook member 15 of the pivot lever 4 engages in the notch 12 and the hinge arm 1 is locked to the mounting plate 2.

The adjustment of the hinge arm 1 is effected, if necessary, in the afore-described manner.

A handle 4' is formed on the pivot lever 4. If the hinge arm 1 is to be released from the mounting plate 2, handle 4' need only be lifted, whereupon the holding projection 15 disengages from the notch 12, and the hinge arm 1 and the intermediate member 3 may be lifted from the mounting plate 2.

To avoid unintentional displacement of the hinge arm 1 in the forward direction, i.e. toward the right with respect to FIG. 2, the two lateral flanges 3' of intermediate member 3 are provided with respective noses 19. When the hinge arm is in the mounted position, noses 19 are disposed directly behind projections 20 of the mounting plate 2 and advantageously abut directly on the front edges 21 of projections 20. In this arrangement the pivot lever 4 need only prevent the hinge arm 1 from being lifted from the mounting plate 2 in the direction of arrow A. This means that minimal forces only have to be received by the pivot lever. The great forces which act in the forward direction are received by the positive locking between the noses 19 and the projections 20.

To facilitate centering of the unit of hinge arm 1 and intermediate member 3 on the mounting plate, recesses 22 are provided directly in front of the noses 19 into which the projections 20 extend.

The noses 19 and the projections 20 are disposed directly adjacent the hook member 15 of the pivot lever 4.

A cover member 23 which covers the joint adjustment screw 6 and the clamping screw 5 is mounted on the hinge arm 1.

The cover member 23 differs from conventional cover members in that at both sides of its rear end there is provided a shoulder 24 which engages under the hinge arm 1 and extends between the hinge arm 1 and the handle 4' of the pivot lever 4. Shoulders 24 prevent pivoting of the pivot lever 4. Hence, as long as the cover member 23 is mounted on the hinge arm 1, the pivot lever 4 cannot disengage, and as a result the hinge arm 1 and the intermediate member 3 cannot be lifted unintentionally from the mounting plate 2.

The cover member 23, which is advantageously injection moulded of plastics material, advantageously has at its rear end a flange 25 which connects the two shoulders 24 and covers the gap between the hinge arm 1 and the pivot lever 4 and handle 4'.

In the illustrated embodiment, the mounting plate 2 is made in two parts.

For vertical adjustment of the hinge arm 1 a clamping screw 16 is released, and an upper part 2' of the mounting plate 2 is displaced relative to a lower part 2''. Tilting of the hinge arm 1 is prevented by the guides 17. When the vertical adjustment has been effected, the clamping screw 16 is fastened.

What is claimed is:

1. In a hinge including a mounting plate, a hinge arm to be linked to another hinge part and having holes through which extend adjusting and fastening screws, an intermediate member engageable with said mounting plate for mounting said hinge arm on said mounting plate, and a pivot lever pivotally mounted on said intermediate member and having a hook member for engaging with a projection of said mounting plate for fastening said intermediate member to said mounting plate, the improvement comprising:

a cover member mounted on said hinge arm, said cover member having at an end thereof a shoulder embracing an adjacent end of said hinge arm and extending between said hinge arm and said pivot lever.

2. The improvement claimed in claim 1, wherein said pivot lever includes a handle, and said shoulder of said cover member extends between said hinge arm and said handle.

3. The improvement claimed in claim 1, wherein said cover member has two shoulders, and each said shoulder projects laterally from a respective opposite side of said cover member.

4. The improvement claimed in claim 3, wherein said hinge arm has a U-shaped profile including two lateral flanges, and said two shoulders rest on respective of said lateral flanges.

5. The improvement claimed in claim 3, wherein said two shoulders of said cover member are connected by a flange.

* * * * *